US010160132B2

(12) United States Patent
Walker et al.

(10) Patent No.: US 10,160,132 B2
(45) Date of Patent: Dec. 25, 2018

(54) FLOW-PROPELLED ROTARY KNIFE

(71) Applicant: J.R. Simplot Company, Boise, ID (US)

(72) Inventors: David Bruce Walker, Meridian, ID (US); Allen J. Neel, Nampa, ID (US)

(73) Assignee: J.R. Simplot Company, Boise, ID (US)

( * ) Notice: Subject to any disclaimer, the term of this patent is extended or adjusted under 35 U.S.C. 154(b) by 336 days.

(21) Appl. No.: 14/937,271

(22) Filed: Nov. 10, 2015

(65) Prior Publication Data

US 2017/0072581 A1 Mar. 16, 2017

Related U.S. Application Data

(60) Provisional application No. 62/217,519, filed on Sep. 11, 2015.

(51) Int. Cl.
*B26D 7/06* (2006.01)
*B26D 3/11* (2006.01)
(Continued)

(52) U.S. Cl.
CPC ..... *B26D 7/0658* (2013.01); *B26D 1/02* (2013.01); *B26D 1/28* (2013.01); *B26D 3/11* (2013.01);
(Continued)

(58) Field of Classification Search
CPC . B26D 7/00; B26D 7/06; B26D 7/065; B26D 7/068; B26D 7/0691
(Continued)

(56) References Cited

U.S. PATENT DOCUMENTS 2,571,300 A * 10/1951 Simpson ..... B01F 7/00391 241/101.8
2,610,664 A * 9/1952 Thompson ..... B26D 3/185 83/420
(Continued)

FOREIGN PATENT DOCUMENTS

DE 69212224 T2 11/1992

OTHER PUBLICATIONS

International Searching Authority; International Search Report and Written Opinion dated Oct. 18, 2016, PCT Patent Application No. PCT/US2016/046183.
(Continued)

*Primary Examiner* — Jason Daniel Prone
*Assistant Examiner* — Richard Crosby, Jr.
(74) *Attorney, Agent, or Firm* — Parsons Behle & Latimer

(57) ABSTRACT

A flow-propelled rotary knife system includes a housing, having an outlet end and walls defining a fluid passage, a rotatable blade holder, disposed at the outlet end and having a central aperture substantially aligned with the fluid passage, and at least one blade, extending diametrically across the central aperture of the blade holder. The blade holder is configured to rotate about a rotational axis passing through the central aperture, and the at least one blade has a twisted shape selected to rotationally propel the blade and the blade holder to rotate about the rotational axis when the blade is contacted by fluid flowing through the fluid passage and the central aperture in a flow direction, whereby objects propelled along the fluid flow path in the flow direction toward the outlet are helically cut by the rotating blade.

21 Claims, 8 Drawing Sheets

(51) Int. Cl.

| | |
|---|---|
| ***B26D 3/26*** | (2006.01) |
| ***B26D 7/26*** | (2006.01) |
| ***B26D 1/02*** | (2006.01) |
| ***B26D 1/28*** | (2006.01) |
| *B26D 1/00* | (2006.01) |

(52) U.S. Cl.
CPC ..... *B26D 3/26* (2013.01); *B26D 7/2614* (2013.01); *B26D 2001/006* (2013.01); *B26D 2001/0053* (2013.01); *B26D 2001/0073* (2013.01); *B26D 2210/02* (2013.01)

(58) Field of Classification Search
USPC ..... 83/403, 404, 407
See application file for complete search history.

(56) References Cited

U.S. PATENT DOCUMENTS 4,206,671 A * 6/1980 Hoehn ..... B26D 1/02 198/676
4,372,184 A * 2/1983 Fisher ..... B26D 3/185 83/102
4,387,111 A * 6/1983 Mullender ..... A23G 3/50 426/512
4,644,838 A * 2/1987 Samson ..... B26D 7/06 83/162
4,911,045 A * 3/1990 Mendenhall ..... B26D 1/0006 83/24
5,385,074 A * 1/1995 Burch, Jr. ..... B26D 3/11 198/625
5,655,428 A * 8/1997 Cockburn ..... B26D 1/0006 83/402
5,694,824 A * 12/1997 Jacko ..... B26D 1/03 83/403
6,928,915 B2 * 8/2005 Jensen ..... B26D 1/03 241/84
7,137,325 B2 * 11/2006 Bajema ..... B26D 1/0006 83/42
7,263,923 B2 * 9/2007 Urschel ..... B26D 1/0006 83/444
7,513,450 B2 * 4/2009 Young ..... B26D 1/0006 241/282.1
9,089,987 B2 7/2015 Walker et al.
9,296,119 B2 * 3/2016 Klockow ..... B26D 7/1845
9,352,479 B2 * 5/2016 Walker ..... B26D 1/0006
2001/0042428 A1 11/2001 Jensen
2003/0232116 A1 12/2003 Fein et al.
2004/0031255 A1 * 2/2004 Kenny ..... A01D 34/005 56/295
2006/0283339 A1 * 12/2006 Jensen ..... A23N 4/14 99/537
2007/0215736 A1 * 9/2007 Young ..... B26D 1/0006 241/292.1
2011/0023729 A1 2/2011 Plaisted et al.
2012/0024125 A1 * 2/2012 Walker ..... B26D 1/29 83/402
2013/0087032 A1 4/2013 Walker et al.
2015/0273719 A1 * 10/2015 Aikens ..... B26D 7/2614 83/523
2016/0016326 A1 * 1/2016 Walker ..... A23P 30/10 426/637
2017/0072581 A1 * 3/2017 Walker ..... B26D 3/11

OTHER PUBLICATIONS

Intellectual Property Office of New Zealand; First Examination Report for New Zealand Patent Application No. 740098 dated Jul. 4, 2018.
Japan Patent Office; Office Action for Japanese Patent Application No. 2018-512929 dated Sep. 12, 2018.

* cited by examiner

FLOW-PROPELLED ROTARY KNIFE

CROSS-REFERENCE TO RELATED APPLICATIONS

This application claims the benefit of U.S. Provisional Patent Application Ser. No. 62/217,519, filed on Sep. 11, 2015 and entitled "Flow-Propelled Rotary Knife," the contents of which are incorporated herein by reference in its entirety.

FIELD OF THE DISCLOSURE

The present application relates generally to systems and methods for cutting products such as vegetables. More particularly, the present disclosure relates to a device and method for simultaneously cutting an entire product into helically twisted pieces using a rotary knife that is rotationally propelled by the flow of water in a water knife system.

BACKGROUND

Water knife cutting systems and related knife fixtures are useful for cutting vegetable products, such as raw potatoes, into spiral or helically shaped pieces, preparatory to further production processing steps such as blanching and par-frying. Rotary knife fixtures that are known and used with water knife systems and that can cut vegetable products or other objects into spiral shaped pieces generally involve power-driven rotary cutting heads. They also include pumps and the like for pumping the fluid in the water knife system. Such systems thus include multiple power-driven devices that operate simultaneously and consume significant power. They can also be complicated for repair and maintenance purposes.

The present application is directed to one or more of the above-mentioned issues.

SUMMARY

It has been recognized that it would be advantageous to develop a water knife cutting system that can cut a product into helically twisted pieces, and that is simpler in design and configuration than other rotary cutting systems.

It has also been recognized that it would be advantageous to develop a water knife cutting system that can cut a product into helically twisted pieces that includes fewer power-driven parts.

In accordance with one aspect thereof, the present application provides a flow-propelled rotary knife system, including a housing, having an outlet end and walls defining a fluid passage, a rotatable blade holder, disposed at the outlet end and having a central aperture substantially aligned with the fluid passage, and at least one blade, extending diametrically across the central aperture of the blade holder. The blade holder is configured to rotate about a rotational axis passing through the central aperture, and the at least one blade has a twisted shape selected to rotationally propel the blade and the blade holder to rotate about the rotational axis when the blade is contacted by fluid flowing through the fluid passage and the central aperture in a flow direction. Objects propelled along the fluid flow path in the flow direction toward the outlet are helically cut by the rotating blade.

In accordance with another aspect thereof, the present application provides a system for cutting vegetable products, including a water knife system having a water conduit configured for transporting vegetable products using a flow of water therethrough at a product speed in a flow direction, a knife fixture positioned along the water conduit, and a flow-propelled rotary knife unit, disposed in the knife fixture and coupled to the water conduit. The rotary knife unit includes a housing, having an inlet end, an outlet end, a blade holder, disposed at the outlet end of the housing, and at least one blade, extending diametrically across the central aperture of the ring, the blade having a twisted shape selected to rotationally propel the ring to rotate about the fluid flow axis when contacted by fluid flowing through the central passage and the central aperture in the flow direction. The housing includes walls defining a central passage having a fluid flow axis, and the inlet end is in fluid communication with the water conduit. The blade holder includes a ring with a central aperture that is substantially aligned with the central passage and the fluid flow axis, the ring being rotatable about the fluid flow axis. Objects propelled along the fluid flow path toward the outlet can be helically cut by the rotating blade.

In accordance with yet another aspect thereof, the present application provides a method for cutting spiral pieces of an object. The method includes providing a flow of water through a water knife system in a flow direction, the water knife system having a knife fixture with a flow passage oriented along an axis, causing the flow of water to impinge upon a rotatable blade of the knife fixture, the flow of water causing the blade to rotate about the axis, and introducing an object into the water knife system upstream of the knife fixture. The blade extends diametrically across the flow passage and has a twisted propeller-like shape with a sharpened cutting edge at one side thereof. Further, the blade is twisted generally at a centerline thereof to define a pair of cutting edges presented generally in opposite-facing circumferential directions, so that when the object is propelled in the flow direction toward the knife fixture, the rotating blade cuts the object in a helical manner as the object passes through the knife fixture.

Figure 1:
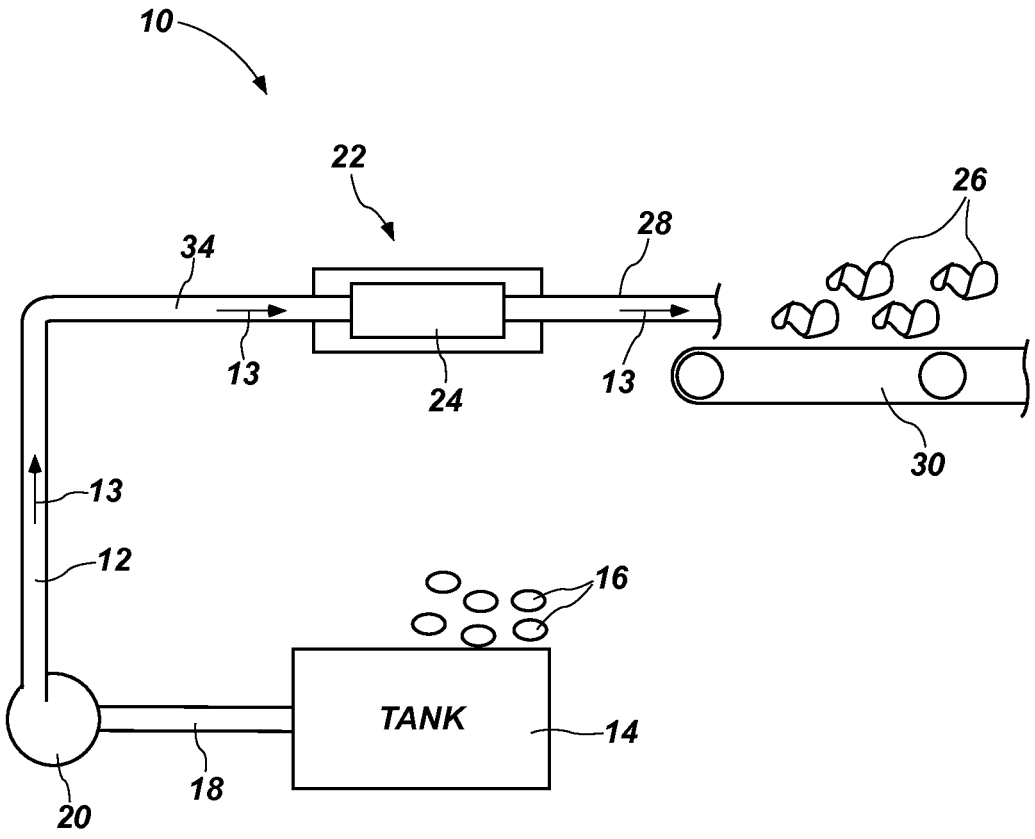
FIG. 1 is a schematic diagram of an embodiment of a hydraulic cutting system that can utilize a flow-propelled rotary knife fixture constructed in accordance with the present disclosure.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

DETAILED DESCRIPTION

Production cutting systems and related rotary knife fixtures are useful for cutting products, such as raw potatoes and other vegetable products, into spiral or helically shaped pieces, preparatory to further production processing steps, such as blanching and par-frying. One typical production system that can be used for such cutting involves a hydraulic cutting system wherein a so-called water knife fixture is mounted along the length of an elongated tubular conduit. A water knife system is a hydraulic system for transporting and cutting objects, such as vegetable products (e.g. potatoes). A pumping device is provided to entrain the product within a propelling flow of water for cutting engagement with rotating knife blades of the water knife fixture. The product units are pumped one at a time in single file succession into and through the water conduit with a velocity and sufficient kinetic energy to carry the vegetable product through a relatively complex rotary knife fixture that includes at least one rotary cutting blade for severing the product into a plurality of smaller pieces of generally spiral or helical shape. The cut pieces are then carried further through a discharge conduit for appropriate subsequent processing, such as cooking, blanching, par-frying, freezing, packaging, etc.

As noted above, rotary knife fixtures that are known and used with water knife systems and that can cut products, such as raw potatoes, into spiral shaped pieces generally involve power-driven rotary cutting heads. Such systems can include multiple power-driven devices and consume significant power, thus including many parts and having a significant level of complexity.

Advantageously, a flow-propelled rotary knife system has been developed that uses the flow of fluid in a water knife system to rotationally propel a rotary knife, thus eliminating the power-driven rotary cutting head and simplifying the system. A flow-propelled rotary knife system in accordance with the present disclosure can be incorporated into various systems for transporting and controlling products to be cut.

One type of water knife system that can incorporate a flow-propelled rotary knife fixture in accordance with the present disclosure is shown in FIG. 1. The water knife system 10 of FIG. 1 includes a water conduit 12 configured for transporting vegetable products using a flow of water therethrough at a product speed in a flow direction, as indicated by arrow 13. This water knife system 10 includes a tank 14 or the like for receiving a supply of vegetable products, such as raw whole potatoes 16 in a peeled or unpeeled state. Alternatively, these potatoes 16 can be halves or pieces of whole potatoes, peeled or unpeeled. The potatoes 16 can be relatively small potatoes or potato pieces having a longitudinal length on the order of about 3 to 5 inches. Whatever the actual potato size, it is generally desirable that the potato have a diametric size that fits through the knife fixture, as described below, but is not too small relative to the size of the conduit 12, such that it will tumble during transport.

As viewed in FIG. 1, the potatoes 16 are delivered via an inlet conduit 18 to a pump 20 which propels the potatoes at a product speed in single file relation in a flow direction within a propelling water stream or flume through a tubular delivery conduit 12 to a cutting unit 22 that is positioned along the water conduit 12 and includes a rotary knife fixture 24 that is in fluid communication with the water conduit 12. In this type of hydraulic cutting system 10, the potatoes 16 can be propelled through the delivery conduit 12 at a relatively high velocity, such as about 25 feet per second (fps), or about 1,500 feet per minute (fpm), to provide sufficient kinetic energy whereby each potato is propelled through the knife fixture 24 to produce (as described in more detail below) elongated spiral cut pieces 26. The spiral cut pieces 26 travel through a short discharge conduit 28 to a conveyor 30 or the like, which transports the cut pieces 26 for further processing, such as blanching, drying, batter coating, parfrying, freezing, etc. A dewatering system (not shown in FIG. 1) can also be positioned at the end of the discharge conduit 28, to separate the cut potato pieces 26 from the transporting fluid of the water knife system 10.

Figure 2:
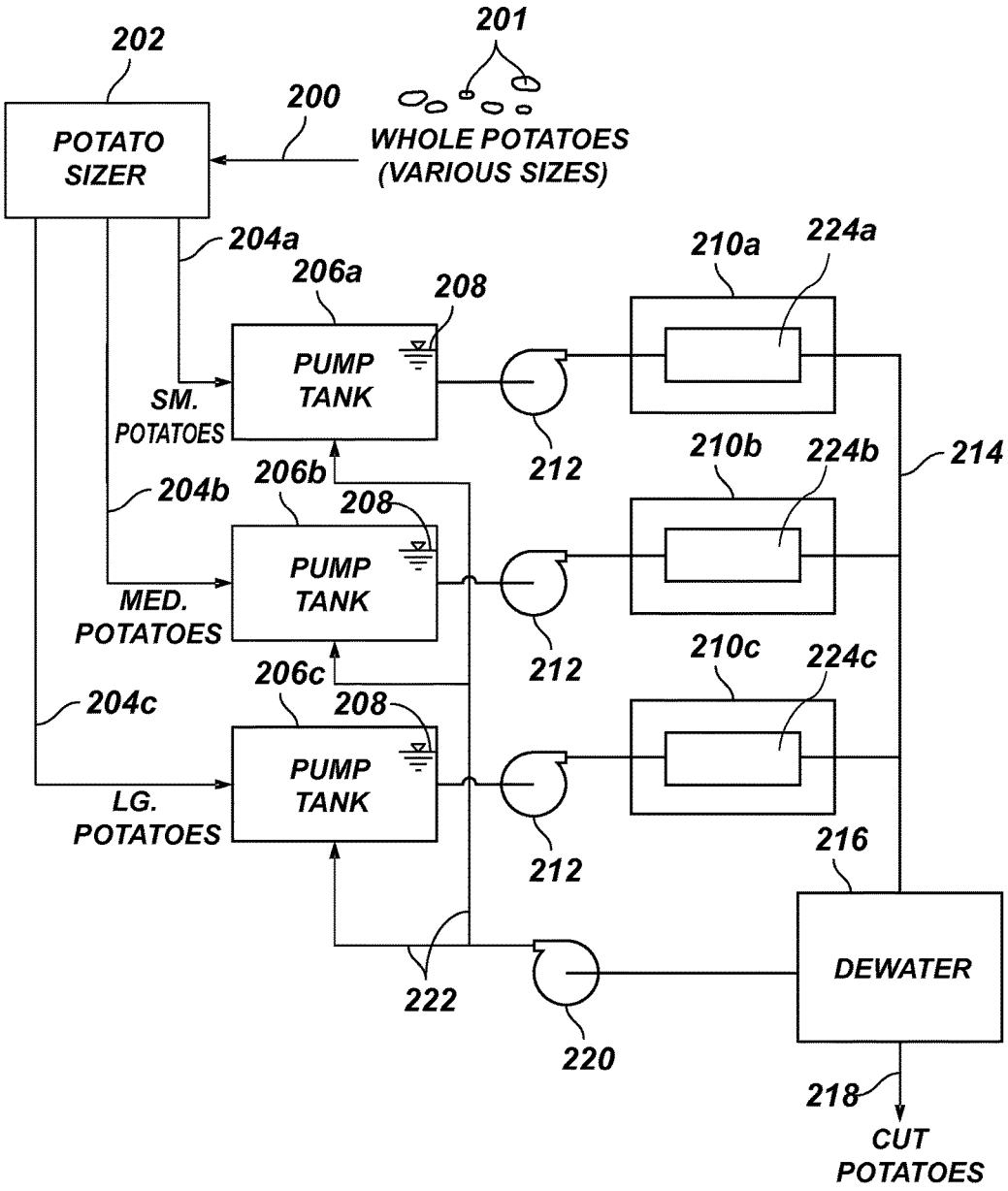
FIG. 2 is a schematic diagram depicting another embodiment of a hydraulic cutting system that can utilize a flow-propelled rotary knife fixture in accordance with the present disclosure.

Other types of systems for transporting and controlling products to be cut can also be used, in addition to the water knife cutting system depicted in FIG. 1. Another embodiment of a system for transporting vegetable products in single file toward a water knife cutting machine is shown in FIG. 2. Advantageously, the water knife system of FIG. 2 simultaneously employs multiple cutting units 210*a-c* arranged in a parallel configuration for cutting products that are transported, such as potatoes. This system generally includes an input stream 200 of products to be cut, which in this case are potatoes 201. The potatoes 201 are of various sizes, and are first fed into a potato sizing machine 202, which segregates the potatoes 201 by size, and selectively discharges them into one of multiple transport conduits 204*a-c*, which provide multiple discrete flow passages. The potato sizing machine 202 in this embodiment thus operates as a selection device for the potatoes that are to be cut. It segregates the potatoes into groups based on size, and introduces each unit of them into a selected flow passage or conduit 204 of the water knife system, depending on the respective size.

Each of the transport conduits 204 lead to a pump tank 206, which stores the potatoes 201 in a hydraulic fluid 208 (e.g. water) in preparation for feeding into a respective cutting unit 210. Each pump tank 206 is connected to a pump 212, which pumps the hydraulic fluid 208 with the potatoes 201 in single file, to a unique cutting unit, generally indicated at 210. In a three machine water knife system, as shown in FIG. 2, the potatoes 201 are sorted into small, medium and large sizes, and conveyed by the respective flow passages 204 to a respective one of three cutting units 210*a-c*. In this way the products to be cut are introduced into a selected flow passage of the water knife system depending on their respective size.

Each cutting unit 210 includes a rotary knife fixture 224 that has an internal flow passage of a unique internal size, and is thus configured to cut products that are in a particular size range. Each knife fixture 224 is a flow-propelled rotary knife fixture, having a blade that is rotationally propelled by the flow of water through the knife fixture, as discussed in more detail below. Because of the flow of fluid through the knife fixture, the products to be cut are propelled in single file in the flow direction toward the respective knife fixture 224, and the rotating blade of the respective knife fixture cuts the object in a helical manner as the object passes therethrough. While the system shown in FIG. 2 includes three cutting units 210*a-c*, other numbers of machines can also be used.

The system of FIG. 2 also includes a collection system, disposed downstream of the vegetable cutting machines, configured to collect the vegetables after cutting. Specifically, following cutting by the knife fixture 224 of the respective cutting machines 210, the potatoes 201 enter a common collection flume 214 which leads to a dewatering machine 216. Those of skill in the art will be aware that food product collection systems often collect product on a conveyor belt, in a flume, or on a vibratory conveyor. Mesh belt conveyors, fixed screens, or vibratory conveyors are frequently used to dewater. The dewatering machine separates the hydraulic fluid (e.g. water) from the potato slices, and discharges the cut and dewatered potato slices in one stream 218 (e.g. on a conveyor belt or chain) and returns the water to the pump tanks 206 via a pump 220 and return water lines 222. While a common collection flume 214 and a single dewatering machine 216 are shown in FIG. 2, it will be apparent that each cutting unit 210 could alternatively be connected to a separate collection flume and dewatering system.

Advantageously, in the knife systems of FIG. 1 and FIG. 2, the knife fixtures 24, 224 can be removable from their respective cutting units 22, 210, so that any knife fixture can be easily removed for cleaning or replacement, or so that a different knife fixture can be installed in its place, if desired.

Figure 3:
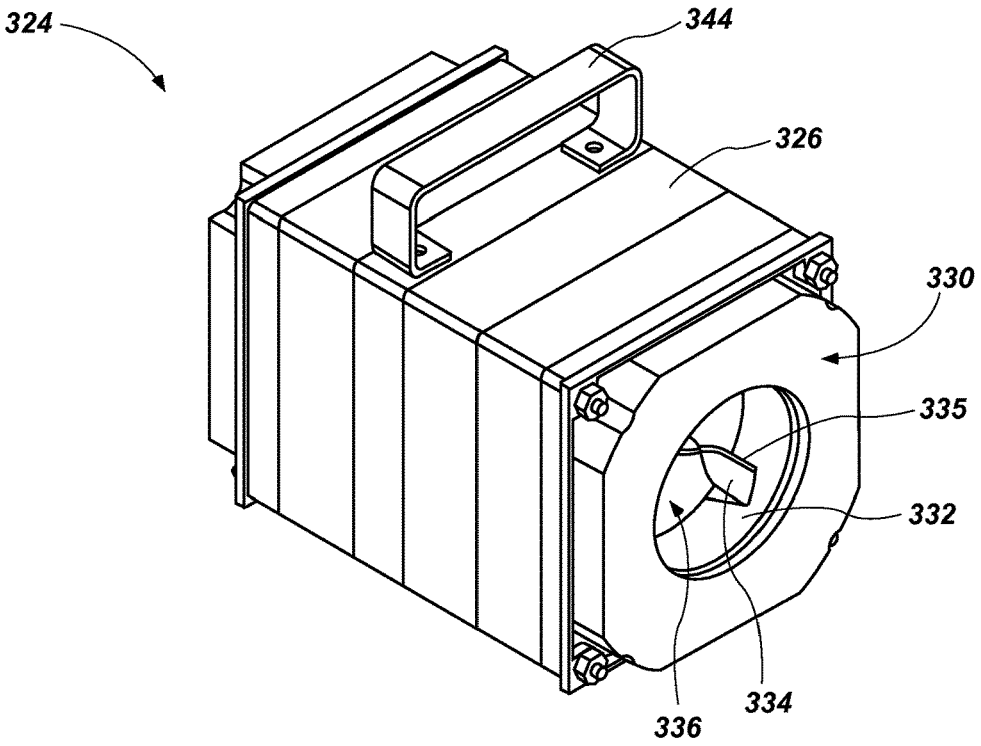
FIG. 3 is a front perspective view of one embodiment of a single-knife flow-propelled rotary knife fixture in accordance with the present disclosure.
Figure 4:
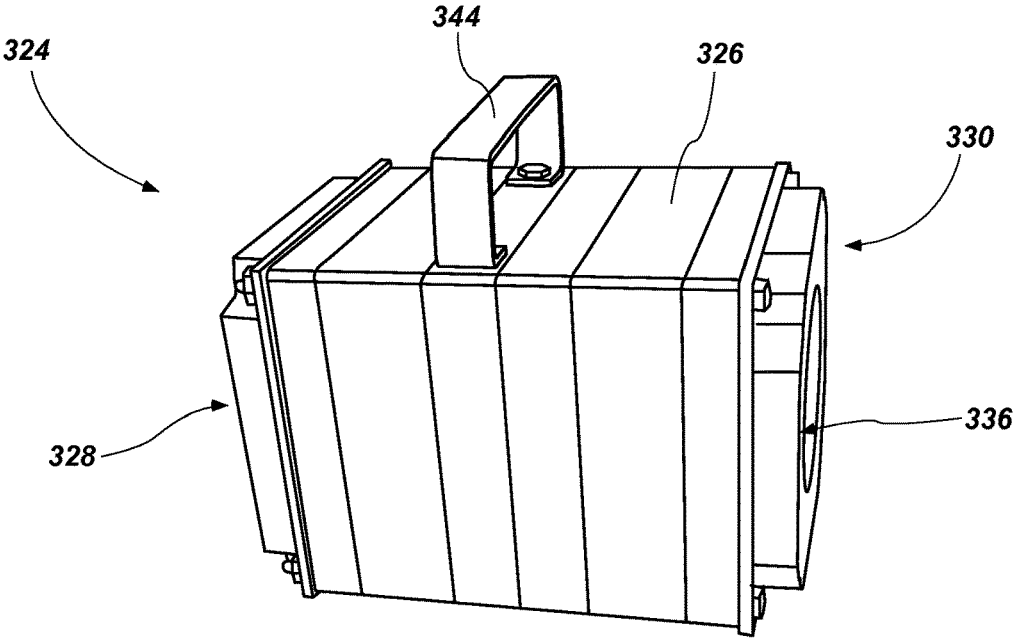
FIG. 4 is a side perspective view of the flow-propelled rotary knife fixture of FIG. 3.

Shown in FIG. 3 is a front perspective view of one embodiment of a single-knife flow-propelled rotary knife fixture 324 in accordance with the present disclosure. FIG. 4 provides a side perspective view of the same, and FIGS. 5A-5D provide cross-sectional views that show some of the internal structure that is not visible in FIGS. 3 and 4. The rotary knife fixture 324 generally includes a housing 326, having an inlet end 328, an outlet end 330, a blade holder/rotor 332, disposed at the outlet end 330, and at least one blade 334, extending diametrically across a central aperture 336 of the blade holder/rotor 332. As shown most clearly in FIGS. 5A-D, the housing 326 includes walls 338 defining a central fluid flow passage 340 having a fluid flow axis 342. The inlet end 328 is configured to be in fluid communication with a water conduit of the water knife system. Advantageously, flow-propelled rotary knife fixture 324 can be an integral unit, configured for selective installation in a cutting unit (210 in FIG. 2) of a water knife system. The cutting unit into which the flow-propelled rotary knife fixture is placed can include a releasable clamp mechanism (not shown) that allows the unit 324 to be rapidly installed in or removed from the cutting unit. The flow-propelled rotary knife fixture 324 can also include a handle 344 on its top, which allows a user to grasp and remove the knife fixture from the cutting unit.

The knife fixture 324 includes at least one rotatable cutting blade 334 for cutting the product into spiral shaped pieces (26 in FIG. 1) of the same or similar size and shape. The blade 334 is attached within the blade holder/rotor 332, which is a ring with a central aperture 336 that is configured to be substantially aligned with the central passage 340 and the fluid flow axis 342 of the housing 326. The blade holder/rotor ring 332 is rotatable about an axis that substantially coincides with the fluid flow axis 342, and the central aperture 336 of the blade holder/rotor 332 and the fluid passage 340 of the housing are of a substantially common size. In one embodiment, the central aperture 336 of the blade holder/rotor 332 and the fluid passage 340 each have a diameter of about 2.75".

The blade 334 has cutting edges 335 and a twisted shape selected to rotationally propel the ring 332 to rotate about the fluid flow axis 342 when contacted by fluid flowing through the central passage 340 and the central aperture 336 in the flow direction, indicated by arrow 348. Advantageously, since the blade 334 is rotationally propelled by the flow of the water in the water knife system, a rotary drive motor or the like is not needed for the knife. The rotation of the blade 334 effectively cuts passing objects into helically shaped pieces, as described herein. The particular geometry of the blade 334 is discussed in more detail below.

Figure 5A:
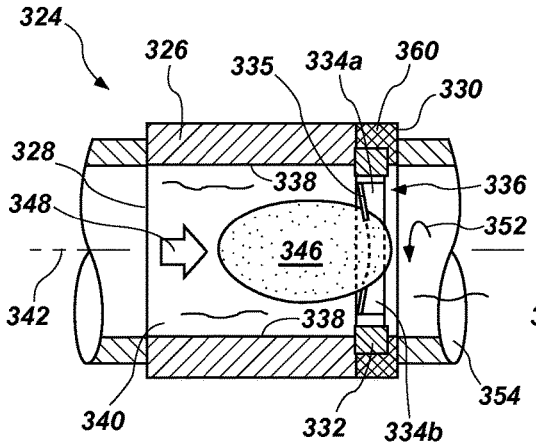
FIGS. 5A-5D are sequential side, cross sectional view of a flow propelled rotary knife fixture like that of FIGS. 3 and 4, showing passage of a potato through the fixture as the knife is rotated by the fluid flow therethrough.

Upon reaching the knife fixture 324, potatoes or other objects that are introduced into the water knife system are propelled by the flow of water through the central passage 340 in the flow direction 348 toward the rotating blade 334, which cuts the object as the object passes through the central aperture 336. This process is depicted in FIGS. 5A-5D, which provide sequential side, cross-sectional views of the flow-propelled rotary knife fixture 324 shown in FIGS. 3 and 4 during passage of a potato 346 therethrough as the knife 334 is rotated by the fluid flow therethrough. As shown in FIG. 5A, as the potato 346 approaches the blade 334, moving in the direction of arrow 348, and then initially meets the blade 334, the rotational motion of the blade 334 causes the cutting edge 335 of the blade to begin cutting a spiral path 350 through the potato 346.

Figure 5B:
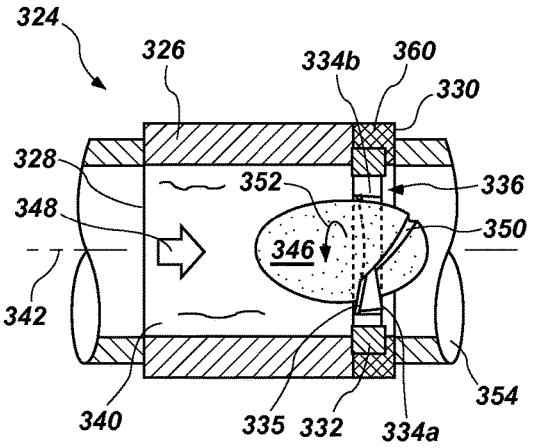

As shown in FIG. 5B, as the potato 346 continues moving in the direction of arrow 348, the blade 334 continues cutting the spiral path 350. It is to be understood that the cut path 350 shown in FIGS. 5A-D only shows one side of the potato 346, and thus only shows the cutting action by one portion of the blade 334 at any given time. Since the blade 334 is rotating around the axis of the knife fixture, as indicated by arrow 352, a first part of the blade 334*a* that is toward the top of FIG. 5A is moving downward and toward the viewer, creating the spiral cut path 350, while a second part of the blade 334*b* that is toward the bottom of FIG. 5A is moving upward and away from the viewer on the opposite side of the potato 346.

Figure 5C:
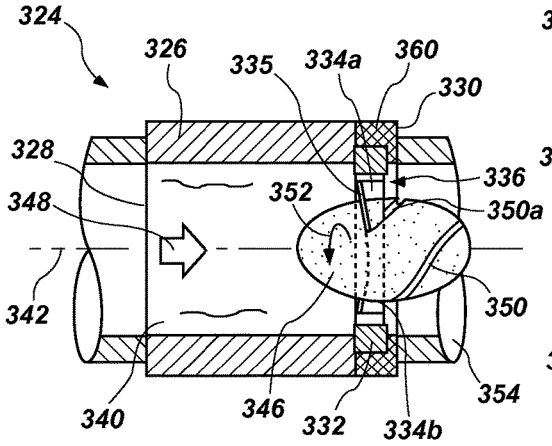

In the view of FIG. 5B, the knife 334 and the ring 332 have rotated such that the first portion of the blade 334*a* has rotated downward, extending the spiral cut path 350, while the second part of the blade 334*b* has rotated up on the other side of the potato 346, cutting a portion of the spiral cut path that is hidden from view. In the view of FIG. 5C, the knife 334 has rotated back to the same position as in FIG. 5A, with the first part of the blade 334*a* toward the top of the potato 346 and moving downward and toward the viewer, creating a second visible portion 350*a* of the helical cut path 350, while the second part of the blade 334*b* is again moving upward and away on the opposite side of the potato 346.

Figure 5D:
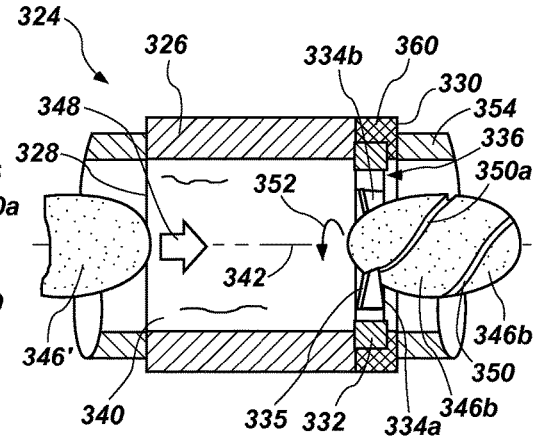

As the blade 334 continues to rotate, it turns to the position shown in FIG. 5D, which is the same blade position as in FIG. 5B. At this point, the potato 346 is nearly completely cut. The first portion of the blade 334*a* has rotated down again toward the bottom of the view, extending the second visible portion 350*a* of the cut 350, while the second portion of the blade 334*b* has rotated up toward the top of the view on the opposite side of the potato 346. When the cut 350 is complete, the separated halves 346*a, b* of the potato 346 will be propelled into the outlet conduit 354, so that another following potato 346' (or other object/vegetable) can then be cut.

Figure 6:
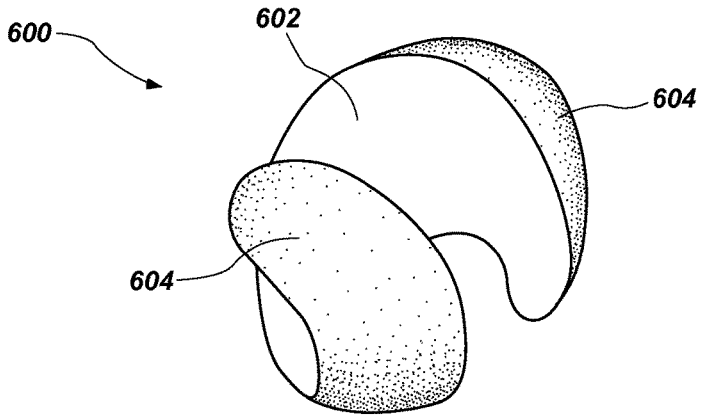
FIG. 6 is a perspective view of a spiral-cut potato piece that can be produced using a single-blade flow-propelled rotary knife fixture like that of FIGS. 3 and 4.

The single blade 334 of the rotary knife fixture shown in FIGS. 3-5D will cut an object, such as a potato, into two helically shaped pieces, and these pieces can generally look like the helically cut potato piece 600 shown in FIG. 6. This figure shows a spiral cut piece 600 of an unpeeled potato, having curved cut surfaces 602, and remaining peel-covered external surfaces 604. Given that the single blade 334 has a smooth cutting edge 335, the spiral cut potato piece 600 has smooth cut surfaces 602.

The illustrations of FIGS. 5A-D show the flow-propelled rotary knife blade 334 undergoing approximately one and one half full revolutions during passage of the length of the potato 346. However, this is not to be interpreted to indicate a required rotational speed of the rotary knife relative to the linear speed of the potato 346. The speed of rotation of the flow-propelled rotary knife is dependent upon the shape of the knife blade 334 and the speed of flow of the fluid, and these variables can be selected within a wide range of values.

Figure 7:
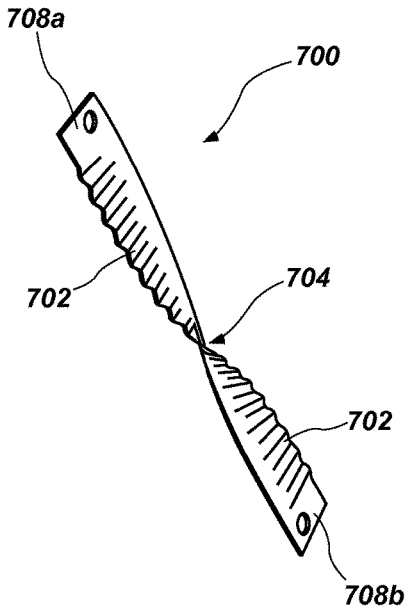
FIG. 7 is a perspective view of a twisted knife configured for use in a flow-propelled rotary knife in accordance with the present disclosure.

Shown in FIG. 7 is a perspective view of a twisted knife 700 configured for use in a flow-propelled rotary knife fixture in accordance with the present disclosure. The blade 700 has a twisted propeller-like shape selected to rotationally propel the blade/ring unit to rotate about the fluid flow axis (342 in FIGS. 5A-5D) when contacted by fluid flowing through the central passage (340 in FIGS. 5A-5D) and the central aperture (336 in FIGS. 5A-5D) in the flow direction (348 in FIGS. 5A-5D). The blade 700 has a sharpened cutting edge 702 along one side, and is twisted generally at a radial center 704, which corresponds to a longitudinal centerline or axis of the hydraulic flow path. The two cutting edges 702 extend radially outwardly in opposite directions, and in opposite-facing circumferential directions.

Figure 8:
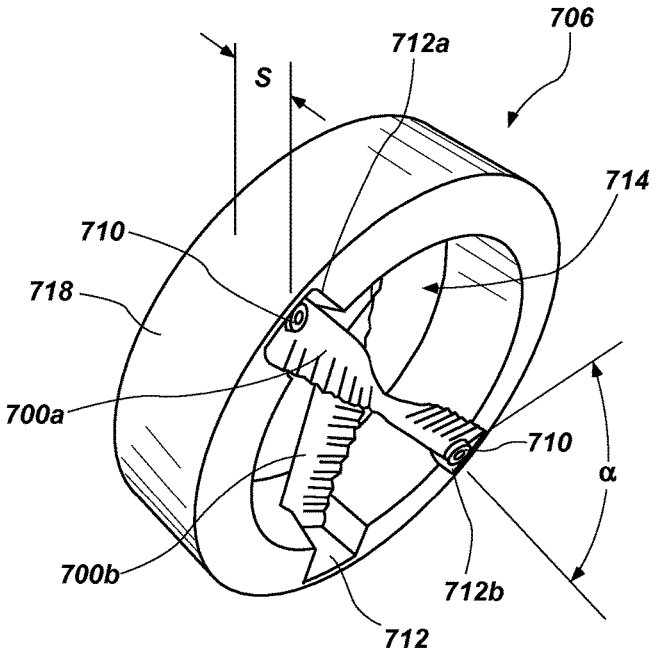
FIG. 8 is a perspective view of an embodiment of a 2-blade blade holder/rotor that can be used in a flow-propelled rotary knife fixture in accordance with the present disclosure.

A perspective view of this sort of blade 700 attached to a corresponding blade holder/rotor ring 706 is shown in FIG. 8. For installation of the blade 700 upon the blade holder/rotor ring 706, opposite ends 708*a, b* of the blade 700 are secured to diametrically opposite portions of the blade holder/rotor ring 706 at a defined pitch angle. Clamp screws 710 or other attachment devices are secured through the respective opposite ends 708*a, b* of the cutting blade 700 to seat the cutting blade 700 within respective shallow recesses 712 formed in the blade holder/rotor ring 706 at the appropriate pitch angle α. When a flow of water impinges upon the rotatable blade 700, its twisted shape naturally rotationally propels the blade and the blade holder/rotor ring 706 as a unit.

The pitch angle α of the blade 700 determines its rotational speed relative to the speed of the flowing water in the water knife system, and also determines the length of the spiral cut. The specific pitch angle α of the cutting blade 700 at each specific point along its radial length can be given by the following formula:

$$\alpha = \mathrm{ArcTan}(2\times\pi\times R/P) \quad [1]$$

where R is the radial distance from the center of the central aperture 714 of the blade holder/rotor 706, and P is the desired pitch length, that is, the length of a single helical cut (i.e. the length of travel of the product to be cut, during which the blade turns one full revolution). As one example, for a total blade radius of 2 inches, and a pitch length of about 3 inches (which is a common length of a small potato), the clamp screws 31 secure the outermost radial ends 708*a, b* of each cutting blade 700 at a pitch angle α of about 76.6° to the axial blade centerline. It will be understood, however, that the specific pitch angle α is a function of radius as defined in equation [1] above. As can be seen in FIGS. 7 and 8, the pitch angle α of the blade increases from the radial center of the ring 706, and it is this pitch angle that determines the spiral shape of the cut product.

As noted above, the cutting blade 334 shown in FIGS. 3-5D has a smooth cutting edge 335, and produces a spiral piece with smooth cut surfaces, as shown by the spiral cut piece 600 in FIG. 6. However, other configurations of the blade can be used. For example, as shown in FIG. 7, the blade 700 can be provided with a corrugated or crinkle-cut cutting edge 702. This cutting edge 702 produces ridged or crinkle-cut surfaces on the cut pieces, such as are shown in the exemplary spiral cut pieces 1100 and 1600 shown in FIGS. 11 and 16. This can be very desirable for both functional and aesthetic reasons. For example, a crinkle-cut surface can allow batter or seasonings to adhere better during subsequent processing. A crinkle-cut surface can also be considered to provide a pleasing appearance. The corrugated or crinkle-cut blade configuration can be applied to any of the knife blade embodiments depicted herein, and different size corrugations or crinkle-cut configurations can be used for the various knife blades.

In the configuration shown in FIGS. 3-5D, the single cutting blade 334 cuts each incoming product 346 into two separate, generally spiral shaped pieces 346*a, b* of similar size and shape. If more spiral shaped pieces are desired from each product unit, a blade holder/rotor with more than one cutting blade can be used. The view of FIG. 8 shows a 2-blade blade holder/rotor 706 that can be used in a flow-propelled rotary knife fixture in accordance with the present disclosure. As shown in FIG. 8, two cutting blades 700*a, b* are supported by the single blade holder/rotor ring 706, and attached by clamp screws 710. Angular recesses 712 and aligned screw ports (not visible in FIG. 8) are formed in the blade holder/rotor ring 706 at the appropriate positions for the clamp screws 710 used to fasten the blades 700 to the blade holder/rotor ring 706. The two cutting blades 700*a, b* are generally identical to each to each other, and are twisted generally at their longitudinal center axis and extend radially outwardly in opposite directions for seated engagement in the recesses at the selected pitch angle, as discussed above.

Figure 11:
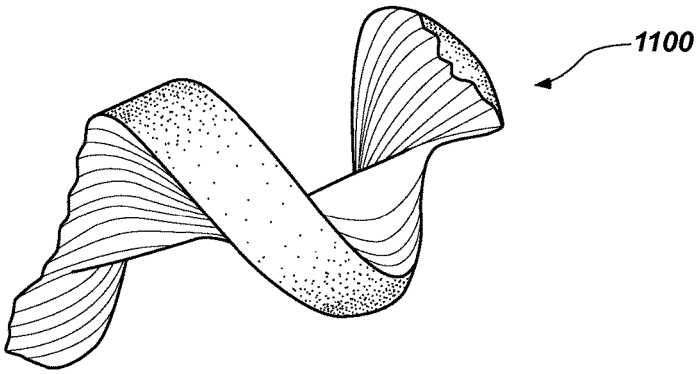
FIG. 11 is a perspective view of a spiral-cut potato piece that can be produced using a 2-blade flow-propelled rotary knife fixture in accordance with the present disclosure.

Those of skill in the art will recognize that each cutting blade 700 will cut the incoming product into two pieces. Consequently, a given rotary knife fixture will produce a number of spiral-shaped pieces that is twice the number of cutting blades used. For example, a single blade system will cut the product into two pieces; a two-blade system will cut a product into four pieces; a three blade system will cut the product into six pieces; and a four blade system will cut the product into eight pieces, and so on. Indeed, any number of cutting blades can be used for subdividing the product into a number of spiral shaped pieces of substantially similar size and shape. Shown in FIG. 11 is a spiral-cut potato piece 1100 that can be produced using a 2-blade flow-propelled rotary knife fixture having a blade holder/rotor ring 706 like that shown in FIG. 8, with two blades 700*a, b* configured for making crinkle-cut pieces.

Where multiple blades are used with a single blade holder/rotor ring, each of the multiple blades are positioned in longitudinal succession, that is, attached to the blade holder/rotor at longitudinally sequential positions relative to the fluid flow axis. The longitudinal spacing S of the blades is indicated in FIG. 8. The longitudinal spacing S can be selected to allow room for blades of sufficient mechanical strength without the need to notch and interlock the blades or weld them together at their intersections. In a multi-blade knife fixture the blades are oriented at an angular offset with respect to each other, relative to the rotational motion of the blade holder/rotor. The offset angle is a controlled angle with respect to the rotation of the blade holder/rotor, and can be selected in order to obtain similar or virtually identical cut spiral shaped pieces. This feature is discussed in more detail below with respect to FIG. 13.

Figure 9:
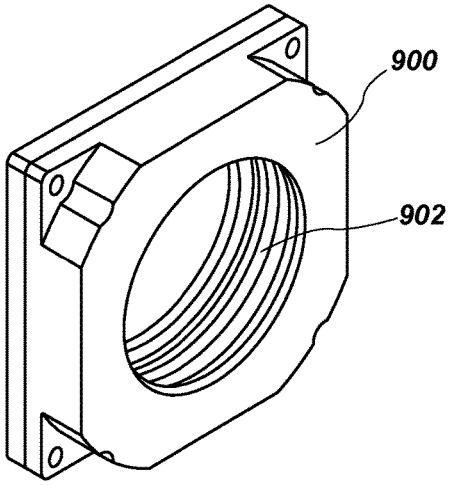
FIG. 9 is a perspective view of an embodiment of a rotor bearing that can be used to support the blade holder/rotor of a flow-propelled rotary knife fixture in accordance with the present disclosure.
Figure 10:
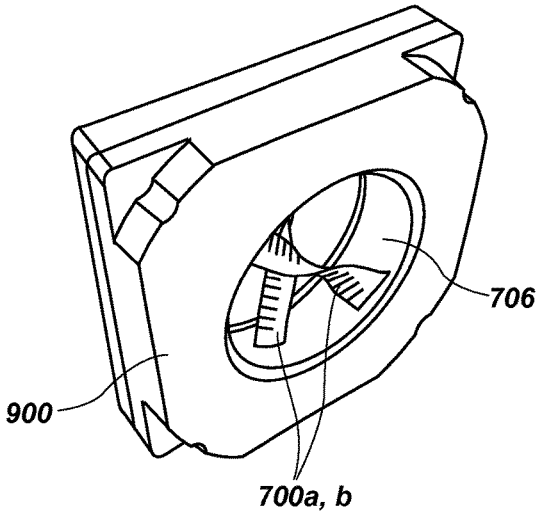
FIG. 10 is a perspective view of the blade holder/rotor of FIG. 8 installed into the rotor bearing of FIG. 9.

Referring back to FIGS. 5A-D, the blade holder/rotor ring 332 is configured to rest in a bearing structure 360 that is positioned at the outlet end 330 of the housing 326 of the flow-propelled rotary knife fixture 324. Shown in FIG. 9 is a perspective view of an embodiment of a rotor bearing housing 900 that can be used to support a blade holder/rotor in this manner. FIG. 10 provides a perspective view of the blade holder/rotor 706 of FIG. 8 installed into the rotor bearing housing 900 of FIG. 9. The bearing housing 900 includes a circular bearing surface 902 adapted to rotationally support an exterior surface (718 in FIG. 8) of the blade holder/rotor ring (706 in FIG. 8), for rotation about the rotational axis (342 in FIGS. 5A-D). FIGS. 8, 9 and 10 illustrate a simple bearing arrangement wherein the inside bearing surface 902 of the bearing housing 900 is configured as a plastic bushing, on which the smooth external surface (718 in FIG. 8) of the rotor 706 slides. This arrangement offers corrosion resistance, low cost, easy sanitation, and can be operated without lubricants. Combinations of roller or ball bearings could also be used instead, though these options are likely to involve higher cost, greater maintenance requirements, and more difficult cleaning procedures.

A variety of materials can be used for the various components of the flow-propelled rotary knife fixture disclosed herein. The blade holder/rotor (332 in FIGS. 3-5D), blades (334 in FIGS. 3-5D), and fasteners (e.g. clamp screws 710 in FIG. 8 and screws 1260 in FIG. 12) can be of stainless steel for strength and corrosion resistance. The knife fixture housing (326 in FIGS. 3-5D), and bearing housing (900 in FIGS. 9, 10) can be of food grade plastic. Ultra-high molecular weight (UHMW) polyethylene was used for a prototype housing due to its high strength and low friction. It is believed that other materials, such as Nylon, Ertalyte and Teflon can also be suitable for these parts.

Figure 12:
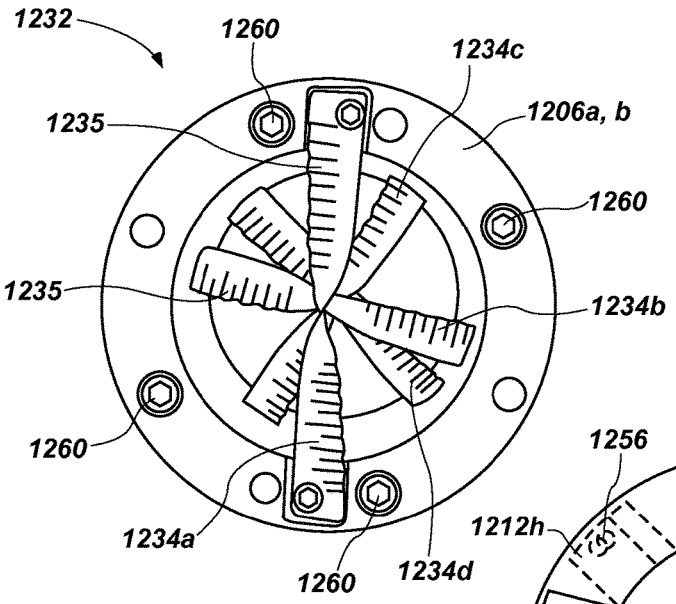
FIG. 12 is a front view of an embodiment of a 4-blade blade holder/rotor that can be used in a flow-propelled rotary knife fixture in accordance with the present disclosure.
Figure 13:
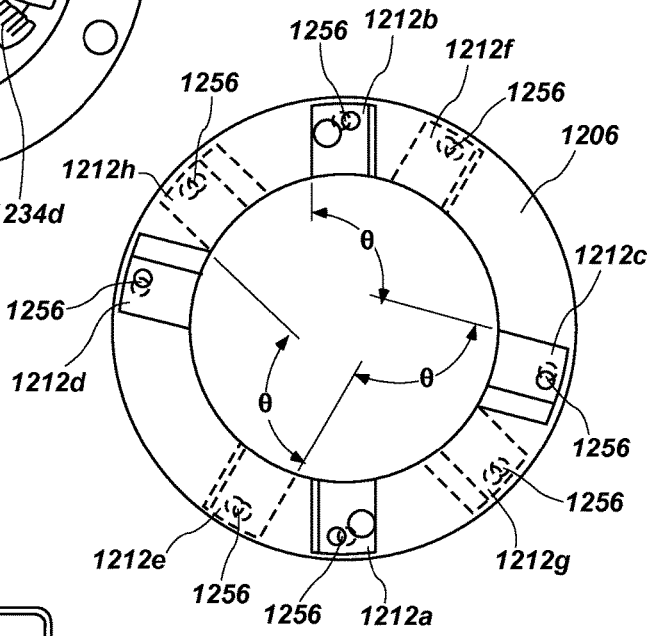
FIG. 13 is a front view of a rotary blade holder ring configured for supporting four blades.
Figure 14:
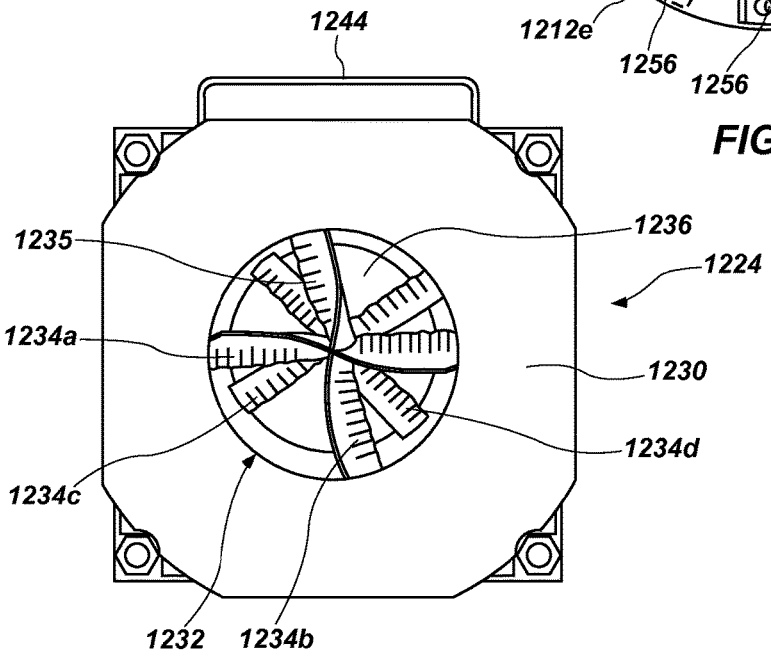
FIG. 14 is a front view of an embodiment of a rotary knife fixture having a 4-blade flow-propelled rotary knife.
Figure 15:
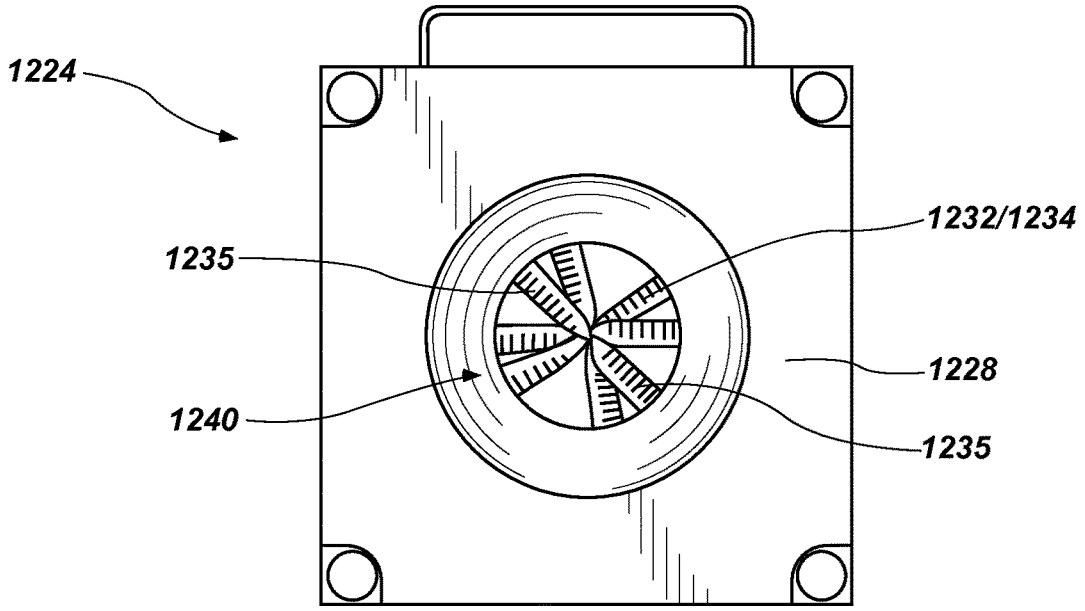
FIG. 15 is a rear view of the rotary knife fixture of FIG. 14, showing the entrance to the fluid passage.

Another exemplary alternative embodiment of a multi-blade flow-propelled rotary knife fixture is shown in FIGS. 12-15. In this embodiment, four cutting blades 1234*a-d* are supported by rotor 1232 that includes a pair of stacked blade holder/rotor rings 1206*a, b* that are each like the blade holder/rotor ring 706 shown in FIG. 8. This rotor 1232 will cut each incoming product into a total of eight spiral shaped pieces. Provided in FIG. 12 is a front view of the 4-blade rotor 1232, and FIG. 13 provides a front view of the stacked rotary blade holder/rotor rings 1206. The rotor includes four blades 1234*a-d*, and each ring 1206 in the stack includes four blade recesses, indicated generally at 1212, one for each end of its two respective blades. The stacked blade holder/rotor rings 1206 thus provide eight total recesses 1212*a-h*, and each recess includes a threaded hole 1256 for receiving a blade clamp screw 1210, shown in FIG. 12. Front and rear views of an embodiment of a complete flow-propelled rotary knife fixture 1224 having a 4-blade rotor 1232 are shown in FIGS. 14 and 15. These views show the blades 1234*a-d*, the central aperture 1236 of the blade holder/rotor ring 1206, and the handle 1244 of the knife fixture 1224.

As noted above, in a multi-blade knife fixture the blades are oriented at an angular offset with respect to each other, relative to the rotational motion of the blade holder/rotor. This angle θ is clearly shown in FIG. 13. The offset angle is a controlled angle that can be selected in order to obtain similar or virtually identical cut spiral shaped pieces. For example, when two cutting blades (e.g. blades 700*a, b* in FIG. 8) are rotated at about 6,000 revolutions per minute (rpm), to advance each product to be cut along the hydraulic flow path at a velocity of about 25 feet per second (fps), the two cutting blades 700 both cut the incoming product into two pieces, for a total of four spiral shaped pieces of similar or identical shape. With a pitch length of about 3 inches potato travel for each cutting blade revolution, and the blades having a longitudinal spacing S of about 0.5 inch, the angle θ (theta) separating each of the supported cutting blades is given by the formula:

$$\theta=[(T/P)\times 360°]+(360°/N) \quad [2]$$

where T is the axial dimension of each blade holder/rotor (i.e. the longitudinal blade-to-blade spacing, which is the same as S, described above), P is the pitch length, and N is the number of cut pieces to be produced. In the case of the two cutting blades 700, adapted to cut each incoming product into four generally identical spiral shaped pieces (i.e. N=4), for example, the angle θ=150°. For three cutting blades, adapted to cut each incoming product into six generally identical spiral shaped pieces (i.e. N=6), for example, the angle θ=120°.

In the examples of FIGS. 12-15, formula [2] is followed to determine the angular setting of each cutting blade in succession in order to form the multiple spiral shaped pieces of identical or similar shapes. Where four blades 1234 are used, as shown in FIGS. 12 and 14-15, the angle θ=105°, such that the four cutting blades 1234*a-d* are set at an angular offset (i.e. successive angles) θ of about 105°, as shown in FIG. 13. In each case, clamp screws 1210 are used to seat each of the cutting blades 1234 at the selected pitch angle α within the recess 1212 formed in the associated blade holder/rotor 1232. Similarly, screws 1260 or the like are fitted and secured through aligned ports (not shown) in the stacked blade holders/rotors 1206 for securing them together for rotation with the bearing assembly (900 in FIG. 9). It will be understood that other forms of the blade holders/rotors and the related interconnection devices can be employed, such as the formation of steps including interengaging tabs and slots in the respective blade holder/rotors 1206 to insure the desired angular position of the cutting blades 1234 and concurrent rotation thereof.

Figure 16:
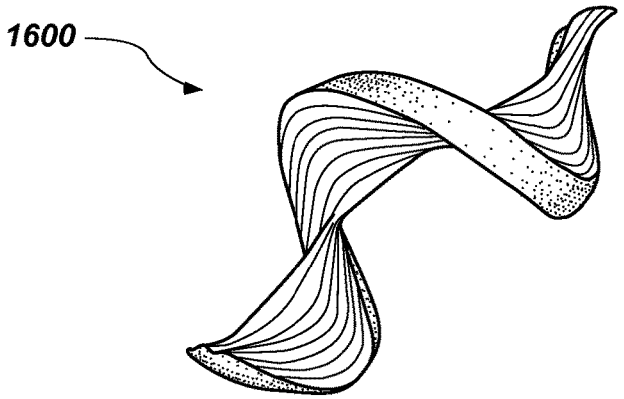
FIG. 16 is a perspective view of a spiral-cut potato piece that can be produced using a 4-blade flow-propelled rotary knife fixture and components like that shown in FIGS. 12-15.

Provided in FIG. 16 is a perspective view of a spiral-cut potato piece 1600 that can be produced using a 4-blade flow-propelled rotary knife fixture 1224 and components like those shown in FIGS. 12-15. In FIG. 15 the inlet end 1228 and the fluid passage 1240 of the knife fixture 1224 are shown, and FIG. 14 shows the outlet end 1230 of the knife fixture 1224. From these and other views herein, it can be seen that the cutting edges 1235 of the twisted blades 1234 face generally backward (i.e. toward the inlet end 1228 of the fluid passage 1240) and are at the leading edges of the blades relative to the rotational motion of the rotor 1232. This orientation aims the sharpened knife edges 1235 toward both the direction of the approaching product and the direction of rotation of the rotor 1232, to provide the desired spiral pitch.

Those of skill in the art will recognize that virtually any number of cutting blades 1234 can be used, with the formula [2] determining the angular spacing of the multiple cutting blades in succession. For example, when five cutting blades are used, a total of ten spiral shaped pieces are formed. Following formula [2], the successive cutting blade angular spacing would be about 96°. Similarly, when six cutting blades are used, a total of twelve spiral shaped pieces are formed; following formula [2], the successive cutting blade angular spacing would be about 90°. Those of skill in the art will also appreciate that the order of the blades can vary when three or more cutting blades are used. That is, formula [2] determines the angular spacing of the blades as a group, but each of the blades need only be set at one of the angular positions. The blades do not need to be set at a regular lag interval, so long as one of the blades in the group is set at each one of the angular positions. For example, where four blades are used, a 105° offset angle is used for the spacing S used herein, as discussed above. In such a case, the first blade is generally set at 0°, the second blade lags the first by 105°, the third lags the first by 210°, and the fourth lags the first by 315°. Thus, the blades (in order) are set at 0°, 105°, 210°, and 315°. However, the system will work equally well if the order of these blades at these offsets is changed. For example, the order could be changed to 0°, 210°, 105° and 315° and still produce all the desired cuts at the proper angles to make even pieces. Alternatively, the order could be changed to 0°, 315°, 210° and 105°. Any order will work so long as one of the blades in the group is set at each one of the angular positions.

It is also to be appreciated that a larger number of blades will produce greater resistance to passage and cutting of the product. The passage of the product is also dependent upon the blade pitch, the speed and pressure of the fluid flow in the central passage, the hardness of the product, and the size of the product relative to the size of the central passage, among other factors. Those of skill in the art will recognize that there will be an upper limit to the number of blades that can be effectively used in a given flow-propelled rotary knife fixture, depending upon these and other factors.

A variety of modifications and improvements in and to the flow-propelled rotary knife fixture of the present invention will be apparent to those of skill in the art. For example, each of the twisted cutting blades could be replaced by a pair of individual blades aligned diametrically with each other and having a pitch angle as defined by formula [1], but otherwise unconnected at the axial centerline of the flow path. As a further alternative, the blades could be non-diametrically aligned, so that an odd number of unconnected blades could be used to produce an odd number of product cuts. Other alternatives are also possible.

Although various embodiments have been shown and described, the present disclosure is not so limited and will be understood to include all such modifications and variations are would be apparent to one skilled in the art.

What is claimed is:

1. A flow-propelled rotary knife system, comprising:

a housing, having an outlet end and walls defining a fluid passage;

a blade holder, disposed at the outlet end, having a central aperture substantially aligned with the fluid passage, and configured to rotate about a rotational axis passing through the central aperture; and at least one blade, extending diametrically across the central aperture of the blade holder, the at least one blade attached to the blade holder, the at least one blade having a twisted shape selected to rotationally propel the blade and the blade holder to rotate about the rotational axis when the at least one blade is contacted by fluid flowing in a fluid flow path through the fluid passage and the central aperture in a flow direction, whereby objects propelled along the fluid flow path in the flow direction toward the outlet end are helically cut by the rotating of the at least one blade.

2. The flow-propelled rotary knife system of claim 1, further comprising a bearing, disposed at the outlet end of the housing, having a circular bearing structure adapted to rotationally support an exterior of the blade holder for rotation about the rotational axis.

3. The flow-propelled rotary knife system of claim 1, wherein the central aperture of the blade holder and the fluid passage of the housing are of a substantially common size.

4. The flow-propelled rotary knife system of claim 3, wherein the central aperture of the blade holder and the fluid passage each have a diameter of about 2 to 3 inches.

5. The flow-propelled rotary knife system of claim 1, wherein the at least one blade has a sharpened cutting edge at one side thereof and is twisted generally at a centerline thereof to define a pair of cutting edges presented generally in opposite-facing circumferential directions.

6. The flow-propelled rotary knife system of claim 5, wherein opposite ends of the at least one blade are secured to diametrically opposite portions of the blade holder at a pitch angle defined by the formula: Pitch Angle=Arc Tan (2×Pi×Radius/Pitch Length), where Radius is a radial distance from a center of the central aperture of the blade holder, and Pitch Length is a distance the product travels during one full rotation of the blade.

7. The flow-propelled rotary knife system of claim 1, wherein the at least one blade comprises at least two blades extending diametrically across the central aperture of the blade holder, and each of the at least two blades attached to the blade holder at longitudinally sequential positions relative to the rotational axis, and oriented at an angular offset with respect to each other relative to the rotational motion of the blade holder.

8. The flow-propelled rotary knife system of claim 7, wherein the angular offset is one of 150°, 120° and 105°.

9. The flow-propelled rotary knife system of claim 1, wherein the at least one blade has a corrugated cutting edge.

10. The flow-propelled rotary knife system of claim 1, wherein the housing, the blade holder and the at least one blade comprise an integral unit, configured for selective installation in a cutting unit of a water knife system.

11. A system for cutting vegetable products, comprising:

a water knife system, including a water conduit configured for transporting vegetable products using a flow of water therethrough at a product speed in a flow direction;

a cutting unit, positioned along the water conduit; and a flow-propelled rotary knife fixture, disposed in the cutting unit and coupled to the water conduit, the flow-propelled rotary knife fixture including a housing, having an inlet end, an outlet end, and walls defining a central passage, the inlet end being in fluid communication with the water conduit and the central passage having a fluid flow axis;

a blade holder, disposed at the outlet end of the housing, having a ring with a central aperture that is substantially aligned with the central passage and the fluid flow axis, the ring being rotatable about the fluid flow axis; and at least one blade, extending diametrically across the central aperture of the ring, the at least one blade being attached to the ring, the at least one blade having a twisted shape selected to rotationally propel the ring to rotate about the fluid flow axis when contacted by fluid flowing in a fluid flow path through the central passage and the central aperture in the flow direction, whereby objects propelled along the fluid flow path toward the outlet end can be helically cut by the rotating of the at least one blade.

12. The system for cutting vegetable products of claim 11, wherein the flow-propelled rotary knife fixture is selectively removable from the cutting unit.

13. The system for cutting vegetable products of claim 11, wherein the at least one blade has a sharpened cutting edge at one side thereof and is twisted generally at a centerline thereof to define a pair of cutting edges presented generally in opposite-facing circumferential directions, and opposite ends of the at least one blade are secured to diametrically opposite portions of the ring at a pitch angle defined by the formula: Pitch Angle=Arc Tan (2×Pi×Radius/Pitch Length), where Radius is a radial distance from a center of the central aperture of the ring, and Pitch Length is a distance the product travels during one full rotation of the blade.

14. The system for cutting vegetable products of claim 11, wherein the at least one blade comprises at least two blades extending diametrically across the central aperture of the ring, and each of the at least two blades attached to the ring at longitudinally sequential positions relative to the fluid flow axis, and oriented at an angular offset with respect to each other relative to the rotational motion of the ring.

15. The system for cutting vegetable products of claim 11, wherein the at least one blade has a corrugated cutting edge.

16. A method for cutting spiral pieces of an object, comprising providing a flow of water through a water knife system in a flow direction, the water knife system having a knife fixture with a flow passage oriented along an axis;

causing the flow of water to impinge upon a rotatable blade of the knife fixture, the blade extending diametrically across the flow passage and having a twisted propeller-like shape with a sharpened cutting edge at one side thereof and being twisted generally at a centerline thereof to define a pair of cutting edges presented generally in opposite-facing circumferential directions, the flow of water causing the blade to rotate about the axis; and introducing an object into the water knife system upstream of the knife fixture, whereby the object is propelled in the flow direction toward the knife fixture, the rotating blade cutting the object in a helical manner as the object passes through the knife fixture.

17. The method of claim 16, wherein the water knife system includes multiple discrete flow passages, each flow passage having a respective knife fixture, each knife fixture having a rotatable blade that is rotationally propelled by the flow of water, each flow passage and knife fixture having a unique internal size, and further comprising:

segregating multiple objects into groups based on size; and introducing the multiple objects each into a selected flow passage of the water knife system depending on the respective size, whereby the objects are propelled in the flow direction toward a respective knife fixture, the rotating blade of the respective knife fixture cutting the object in a helical manner as the object passes therethrough.

18. The method of claim 16, wherein causing the flow of water to impinge upon the rotatable blade comprises causing the flow of water to impinge upon at least two blades of the knife fixture, the at least two blades each extending diametrically across the flow passage and having a twisted propeller-like shape with a sharpened cutting edge at one side thereof and being twisted generally at a centerline thereof to define a pair of cutting edges presented generally in opposite-facing circumferential directions, the at least two blades attached to a blade holder at longitudinally sequential positions relative to the flow direction and the axis, and oriented at an angular offset with respect to each other.

19. The method of claim 16, wherein introducing the object into the water knife system comprises introducing a vegetable into the water knife system.

20. The method of claim 19, wherein the vegetable is a potato.

21. The method of claim 16, further comprising providing corrugations on the cutting edge of the blade, whereby the blade cuts a ridged surface in the object.

* * * * *